US007448611B2

(12) United States Patent
Chang

(10) Patent No.: US 7,448,611 B2
(45) Date of Patent: Nov. 11, 2008

(54) PICKUP DEVICE USED WITH IMAGE FORMING APPARATUS

(75) Inventor: Won-kil Chang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 228 days.

(21) Appl. No.: 11/000,996

(22) Filed: Dec. 2, 2004

(65) Prior Publication Data

US 2005/0127592 A1 Jun. 16, 2005

(30) Foreign Application Priority Data

Dec. 13, 2003 (KR) ..... 10-2003-0090967

(51) Int. Cl.
*B65H 3/06* (2006.01)

(52) U.S. Cl. ..... 271/114; 271/116; 271/117

(58) Field of Classification Search ..... 271/114, 271/116, 117, 109
See application file for complete search history.

(56) References Cited

U.S. PATENT DOCUMENTS 4,858,907 A 8/1989 Eisner
5,141,217 A * 8/1992 Lim et al. ..... 271/10.13
5,435,539 A * 7/1995 Namiki ..... 271/114
5,624,109 A 4/1997 Tanaka
5,630,580 A * 5/1997 Tsao et al. ..... 271/10.13
5,873,441 A * 2/1999 Tsujishita ..... 192/46
6,059,279 A * 5/2000 Wenthe, Jr. ..... 271/10.13
6,168,147 B1 * 1/2001 Nose et al. ..... 271/10.13
6,293,539 B1 9/2001 Fukatsu
6,817,793 B2 * 11/2004 Kelsay et al. ..... 400/578

FOREIGN PATENT DOCUMENTS

JP 55-067467 5/1980
JP 08-207404 8/1997
KR 1998-41236 9/1998

* cited by examiner

*Primary Examiner*—Kaitlin S Joerger
(74) *Attorney, Agent, or Firm*—Stanzione & Kim, LLP

(57) ABSTRACT

A pickup device used with an image forming apparatus includes a driving roller, a pickup roller that receives a driving force from the driving roller and picks up sheets of paper one by one, and a lockup prevention device that is placed inside the pickup roller and controls an axle of the pickup roller and the pickup roller to slide so that an overload of the pickup roller is not transmitted to the driving roller.

29 Claims, 6 Drawing Sheets

PICKUP DEVICE USED WITH IMAGE FORMING APPARATUS

CROSS-REFERENCE TO RELATED APPLICATIONS

This application claims the priority of Korean Patent Application No. 2003-90967, filed on Dec. 13, 2003, in the Korean Intellectual Property Office, the disclosure of which is incorporated herein in its entirety by reference.

BACKGROUND OF THE INVENTION

1. Field of the Invention

The present general inventive concept relates to a pickup device used with an image forming apparatus, and more particularly, to a pickup device used with an image forming apparatus, which does not overload a driving motor even if a paper pickup roller is overloaded.

2. Description of the Related Art

FIG. 1 is a side cross-sectional view showing a conventional pickup device in an image forming apparatus, to illustrate a paper pickup motion, and FIG. 2 is a side cross-sectional view showing the conventional pickup device of FIG. 1, to illustrate an overloaded state when the conventional pickup device is not able to pickup paper.

Referring to FIG. 1, a paper supporter 11 is mounted on a cassette 10 and a spring 12 elastically supports the paper supporter 11. Sheets of paper S are piled on the paper supporter 11.

A pickup device 20 is placed on the upper portion of the cassette 10 to pickup the sheets of paper S one by one. The pickup device 20 is placed on an axle 22 so that the pickup device 20 can rotate with respect to the axle 22. The pickup device 20 includes a driving roller 21 that receives a driving force from a driving motor (not shown), a pickup roller 24 that is in contact with the sheets of paper S and picks up the sheets of paper S, and a plurality of idle rollers 23 that connect the driving roller 21 and the pickup roller 24 and send the driving force of the driving roller 21 to the pickup roller 24.

The pickup device 20 pivots in a direction of an arrow "A" with respect to an axis of the axle 22. To pickup the sheets of paper S, the pickup device 20 moves from a position indicated by a dotted line toward the sheets of paper S. Then, the pickup roller 24 comes in contact with one sheet of paper S, picks up the sheets of paper S one by one by a friction with the sheets of paper S, and feeds the sheets of paper S into a main body of the image forming apparatus.

Recently, as different types of paper are used, a friction between a sheet of paper and a pickup roller differs according to each type of paper. That is, some sheets of paper have a smoother surface than ordinary sheets of paper to allow a clearer development of an image and some sheets of paper have different finishing on each side of the paper, which makes it difficult for a pickup roller to pickup the paper because the friction between the pickup roller and the paper varies according to the different finishing on each side of the paper.

Referring to FIGS. 1 and 2, the pickup device 20 moves with the axle 22, and the pickup roller 24 comes in contact with the sheets of paper S and rotates. However, the pickup roller 24 cannot pickup the sheets of paper S. In this case, the pickup device 20 moves further towards the sheets of paper S with respect to the axle 22 and applies a higher vertical force in a direction of an arrow "B" to increase a friction with the sheets of paper S.

As such, the pickup roller 24 is overloaded and the overload is passed on to the idle roller 23, the driving roller 21, and finally to the driving motor (not shown), thereby damaging the driving motor.

SUMMARY OF THE INVENTION

In order to solve the foregoing and/or other problems, it is an aspect of the present general inventive concept to provide a pickup device used with an image forming apparatus, the pickup device not being affected by an overload even if the pickup roller is overloaded due to a difference in friction according to different types of paper.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a pickup device having a driving roller, a pickup roller that receives a driving force from the driving roller and picks up sheets of paper one by one, and a lockup prevention device that is placed inside the pickup roller, and controls a rotating axle of the pickup roller and the pickup roller to slide so that an overload of the pickup roller is not transmitted to the driving roller.

The foregoing and/or other aspects of the present general inventive concept may also be achieved by providing an image forming apparatus including a paper cassette where sheets of paper are loaded, and a transfer device that transfers the sheets of paper to a main body to form an image on the sheets of paper, the image forming apparatus including a pickup device that picks up the sheets of paper from the paper cassette one by one to feed the picked-up sheet of paper to the transfer device, the pickup device including a driving roller, a rotating axle, a pickup roller that receives a driving force from the driving roller through the rotating axle and picks up the sheets of paper one by one, and a lockup prevention device that is disposed between the pickup roller and the rotating axle and controls the pickup roller and the rotating axle to slide so that an overload of the pickup roller is not transmitted to the driving roller.

The foregoing and/or other aspects of the present general inventive concept may also be achieved by providing a pickup device used with an image forming apparatus, the pickup device including a driving roller, a pickup roller to pickup sheets of paper, a rotating axle to transmit a driving force from the driving roller to the pickup roller, and a lockup prevention device disposed between the pickup roller and the rotating axle to transfer the driving force from the rotating axle to the pickup roller and not to transfer from the pickup roller to the driving roller through the rotating roller.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Figure 1:
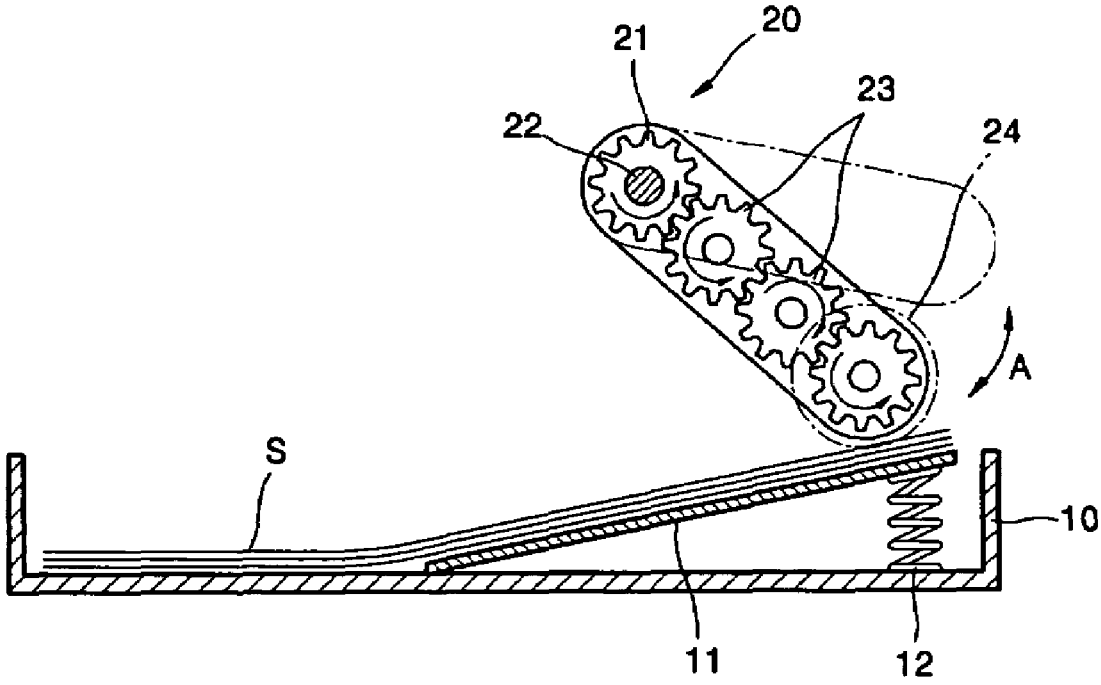
FIG. 1 (PRIOR ART)
FIG. 1 is a side cross-sectional view showing a conventional pickup device in an image forming apparatus, to illustrate a paper pickup motion.
Figure 2:
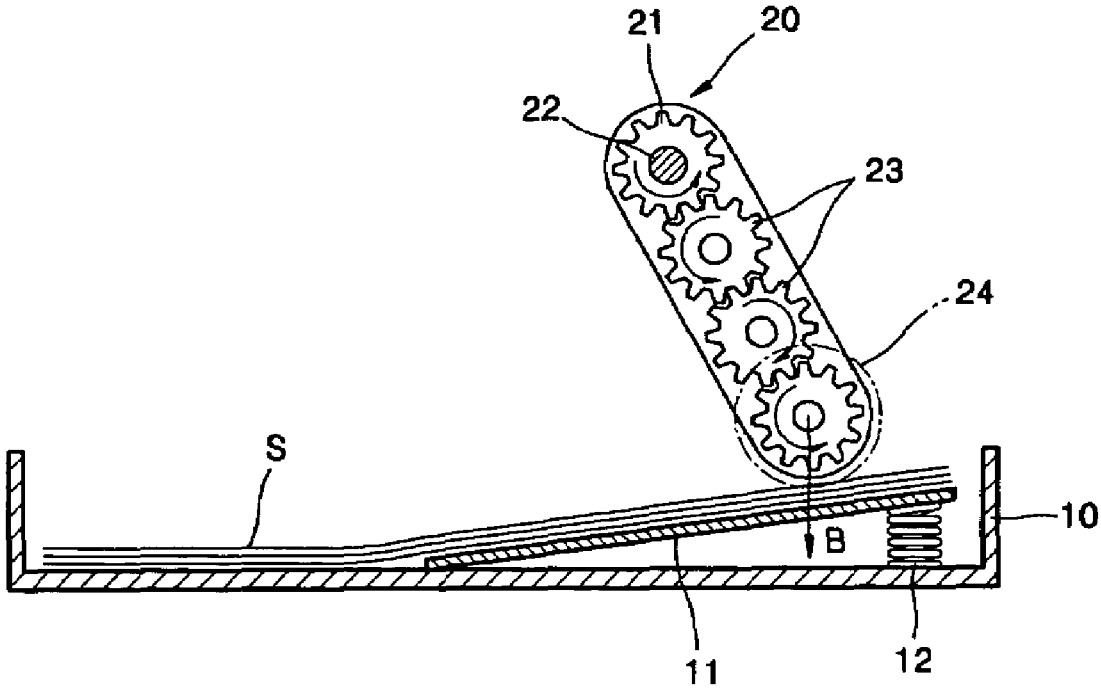
FIG. 2 (PRIOR ART)
FIG. 2 is a side cross-sectional view showing the conventional pickup device of FIG. 1, to illustrate an overloaded state when the conventional pickup device is not able to pickup paper.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
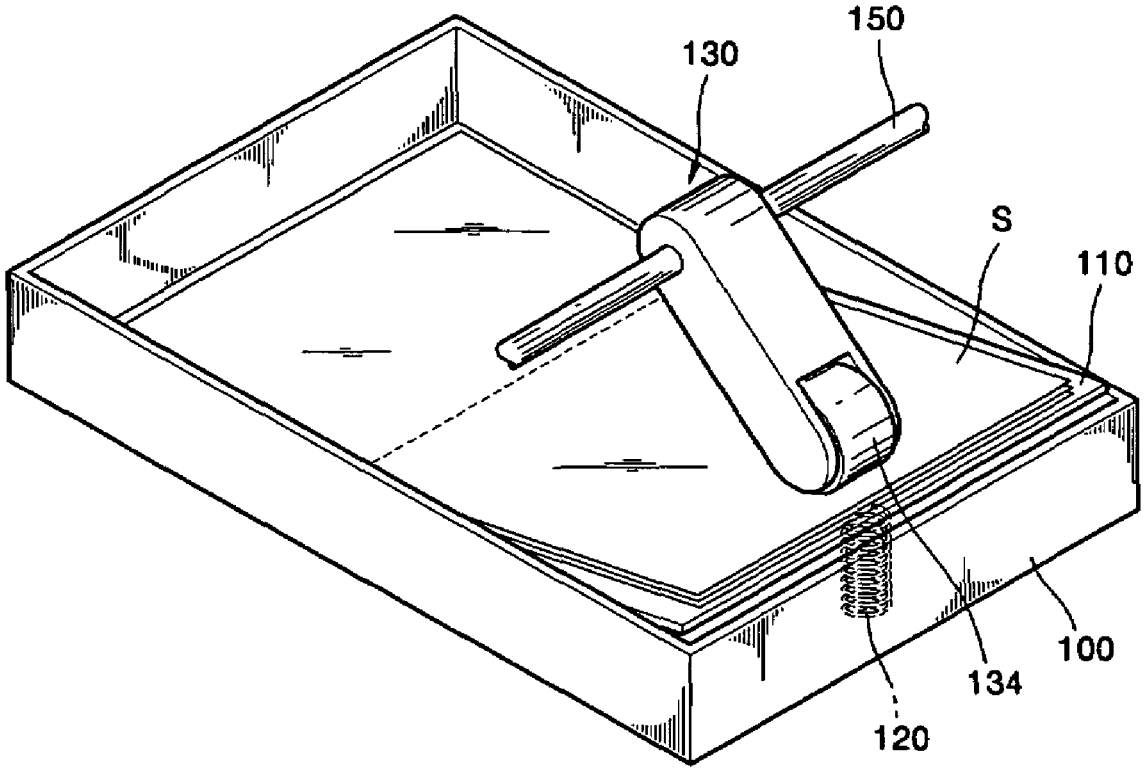
FIG. 3 is a schematic structural diagram showing a pickup device used with an image forming apparatus according to an embodiment of the present general inventive concept.
Figure 4:
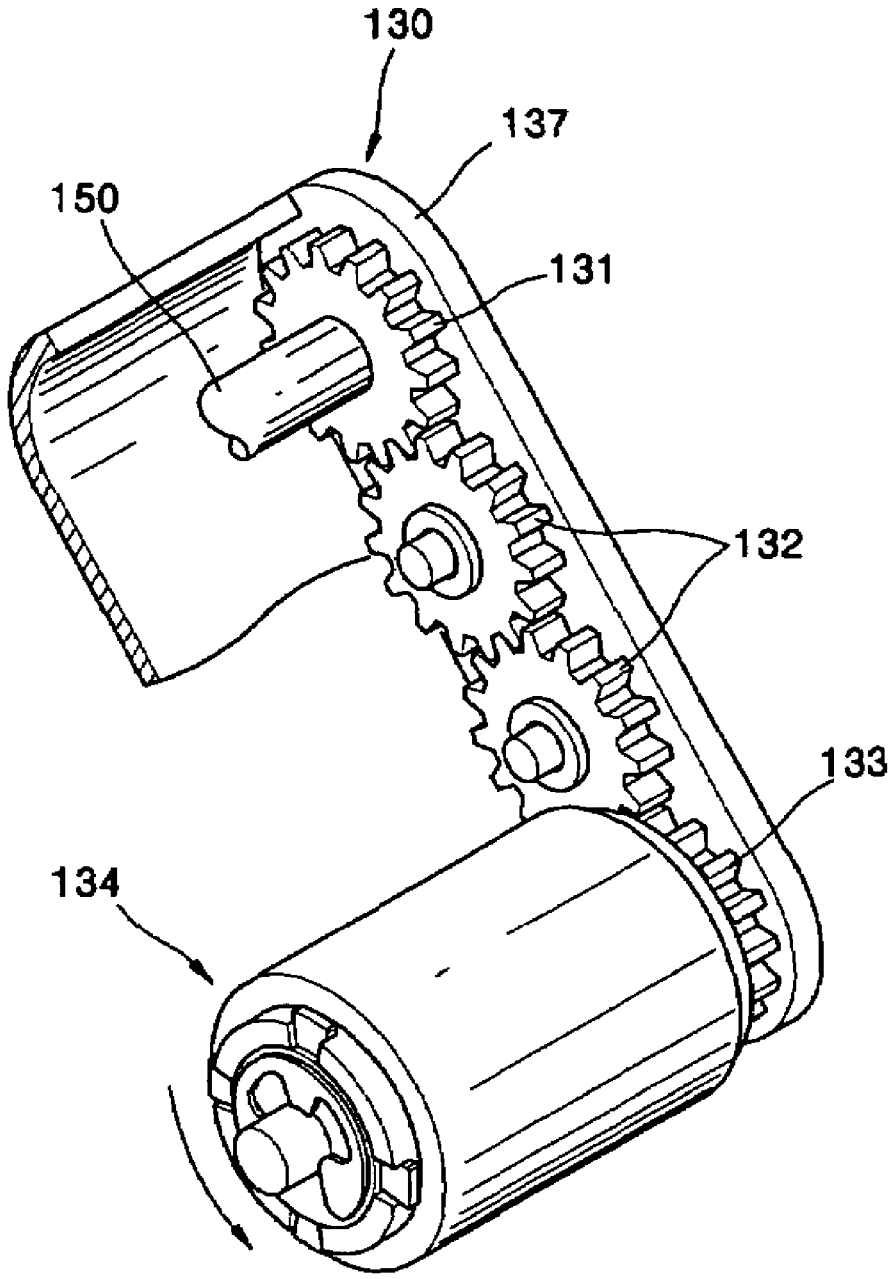
FIG. 4 is a partial, broken away perspective view showing a pickup device according to another embodiment the present general inventive concept.
Figure 5:
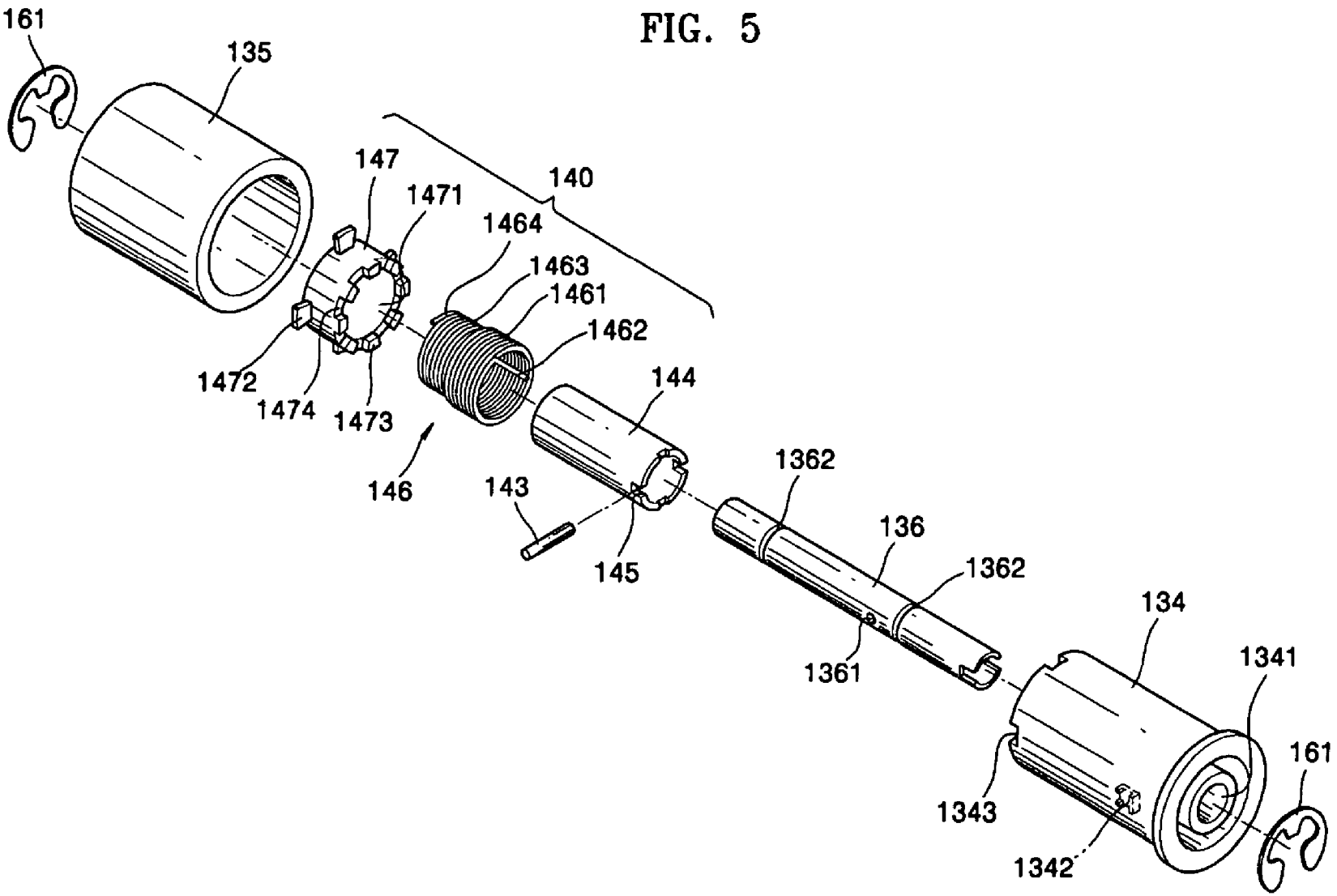
FIG. 5 is an exploded perspective view of a pickup roller of FIG. 4 and a lockup prevention device.

Referring to FIGS. 3 through 5, a pickup device 130 is placed on an upper portion of a paper cassette 100 loaded with sheets of paper S, to pick up the sheets of paper S supported by a plate and a spring 120. The pickup device 130 may comprise a housing 137, a driving roller 131, a pickup roller 134, an idle gear 132, and a lockup prevention device 140. The driving roller 131 rotates together with a driving axle 150 that receives a driving force from a power source (not shown). The pickup roller 134 becomes in contact with the sheet of paper S to pick up the sheets of paper S one by one. The idle gear 132 passes on the driving force of the driving roller 131 to a pickup gear 133 to rotate the pickup roller 134. The lockup prevention device 140 can be disposed inside the pickup roller 134 and prevents an overload of the pickup roller 134 from being transferred to the driving roller 131.

The pickup roller 134 may have a support hole 1341 through which a rotating axle 136 that rotates in connection with the pickup gear 133 is inserted, a number of recessed fixed stopping portions 1343 that are formed on one side of the pickup roller 134 to be fixedly coupled to a cap 147, and a fixing unit 1342 that is formed inside the pickup roller 134 and is fixedly coupled to a first lead 1462 of an elastic unit 146.

An outer circumference of the pickup roller 134 can be formed with a friction portion 135 that directly contacts the sheets of paper S and is made of a material that can pick up the sheets of paper S by a friction produced between a contact portion of the friction portion 135 and a surface of each sheet of paper S.

The cap 147 formed with a second support hole 1471 can be placed in the pickup roller 13 to support one side of the rotating axle 136 which is inserted into the second supporting hole 1471. A plurality of fixed protrusions 1472 can be formed on an outer circumference of the cap 147 to be interlocked to the recessed fixed stopping portions 1343 formed on the one side of the pickup roller 134.

A plurality of protrusions 1473 can be formed along a side circumference of the cap 147 at a predetermined distance. A number of recesses 1474 that are relatively low in height compared to the protrusions 1473 can be formed between the protrusions 1473.

Therefore, the cap 147 can be interlocked to the one side of the pickup roller 134 and rotates together with the pickup roller 134 while supporting the rotating axle 136.

The lockup prevention device 140 can include a middle element 144 and the elastic unit 146. One side of the middle element 144 can have an incision portion 145, and a stopping unit 143 can be placed through the incision portion 145 and a through hole 1361 and can pass through the rotating axle 136 to secure the middle element 144 to the rotating axle 136. Consequently, as the rotating axle 136 rotates, the stopping unit 143 secured to the rotating axle 136 can also control the middle element 144 to rotate.

The elastic unit 146 can have a winding portion 1463 wrapped around in contact with the middle element 144 and a transition portion 1461 that has a larger circumference than the winding portion 1463 so as not to contact an outer surface of the middle element 144. The winding portion 1463 and the transition portion 1461 can be formed as a single body.

The first lead 1462, which is one end of the transition portion 1461 of the elastic unit 146, can be fastened to the fixing unit 1342 inside the pickup roller 134. A second lead 1464, which is another end of the winding portion 1464 of the elastic unit 146, can be in contact with either the protrusion 1473 or the recess 1474 of the cap 147.

A number of grooves 1362 can be formed on the rotating axle 136 at a predetermined distance from each other. The pickup roller 134 can be secured to the rotating axle 136 by placing a fixing ring 161 into each groove 1363 after the pickup roller 134 is inserted around the rotating axle 136.

An operation and a movement of a pickup device according to another aspect of the present general inventive concept will be described in more detail with reference to FIGS. 3-7.

The operation and the movement of the pickup device will be described in two different parts: when the pickup roller picks up paper and when the pickup roller cannot pick up paper because the pickup roller is overloaded.

The operation and the movement of the pickup roller 134 picking up paper will be described.

When the rotating axle 136 rotates in a direction of an arrow "C" after receiving the driving force from the pickup gear 133 through the driving roller 131 and the idle gear 132, the winding portion 1463 that is in contact with the middle element 144 can rotate together with the middle element 144.

In the meantime, an elastic force of the transition portion 1461 can make the transition portion 1461 unwounded in a direction of an arrow "D" and can send a rotating force of the rotating axle 136 to the pickup roller 134 because the first lead 1462 of the transition portion 1461 is secured to the fixing unit 1342 of the pickup roller 134. Thus, a relative speed difference can occur between the rotating axle 136 and the pickup roller 134 because of the transition portion 1461. The relative speed difference can also occur between the first lead 1462 and the second lead 1464 due to the elastic force of the transition portion 1461.

Meanwhile, the second lead 1464 of the winding portion 1463 can be in contact with either the protrusion 1473 or the recess 1474 of the cap 147, and the cap 147 and the pickup roller 134 can be interlocked with each other. Thus, when the rotating axle 136 rotates in the direction of the arrow "C," the second lead 1464 of the winding portion 1463 can also rotate together with the rotating axle 136 in the direction of the arrow "C." However, the pickup roller 134 and the first lead 1462 of the winding portion 1461 do not rotate together with the rotating axle 136 because the winding portion 1461 becomes unwound.

Figure 6:
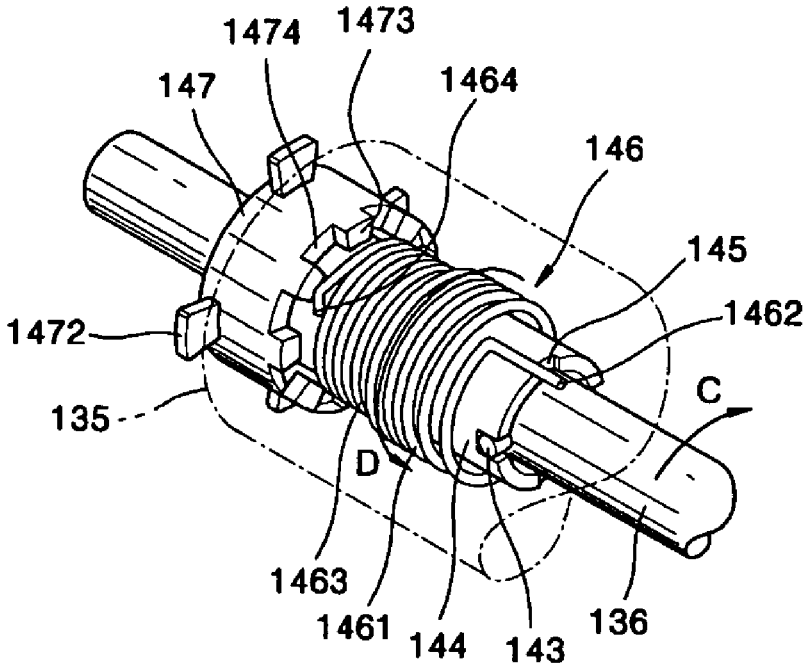
FIGS. 6 and 7 are perspective views showing movements of the lockup prevention device of FIG. 5.
Figure 7:
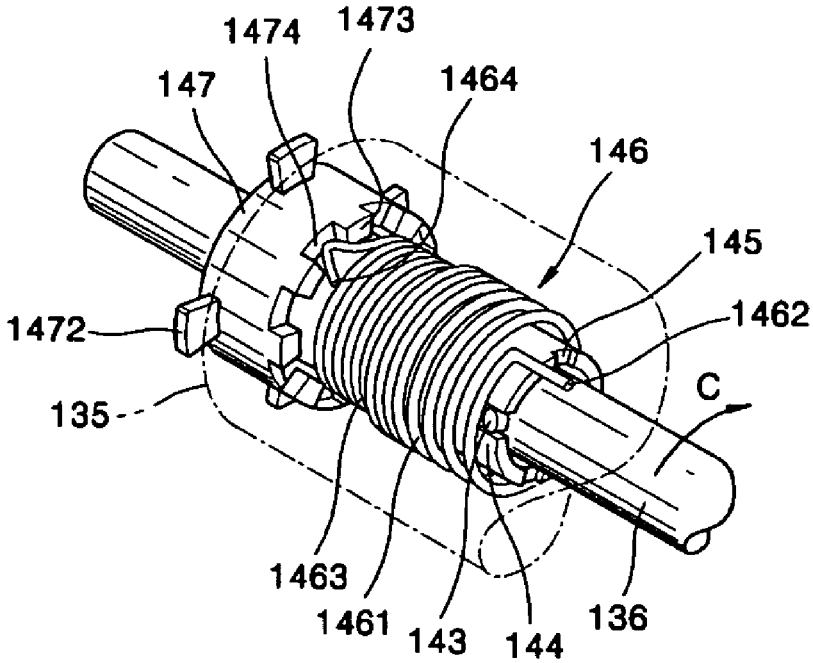

Therefore, as illustrated in FIGS. 6 and 7, the second lead 1464 contacting the recess 1474 can become in contact with the protrusion 1473, and then the second lead 1464 can become in contact with the adjacent recess 1474 to the protrusion 1413. These operations can be alternatively repeated, which consequently produces the pickup roller 134 to vibrate. This vibration helps the pickup roller 134 contact the surface of each sheet of paper S with ease.

The movement of the pickup roller which is overloaded will be described hereinafter.

When the pickup roller 134 is overloaded due to a friction between the paper S and the pickup roller S, the pickup roller 134 cannot rotate in the direction of the arrow "C" because of the overload. Even if the rotating axle 136 rotates in the direction of the arrow "C" and the pickup roller 134 can not rotate because of the overload, a slide can be produced between the winding portion 1464 and the middle element 144.

As a result, the overload of the pickup roller 134 can not be transferred to the middle element 144, the rotating axle 136 and ultimately to the driving roller 131. In other words, the overload is not transferred to the rotating axle 136 because the elastic unit 146 and the middle element 144 slide when the pickup roller 134 is overloaded.

Meanwhile, the second lead 1464 of the winding portion 1463 can be in contact with either the recess 1473 or the protrusion 1474 of the cap 147. When the pickup roller 134 is overloaded, the transition portion 1461 becomes unwound, and the winding portion 1463 rotates together with the rotating axle 136 and controls the elastic unit 146 to relatively slide over the middle element 144. Thus, the relative speed difference between the unwound transition portion 1461 and a rotation of the winding portion 1463 can control the second lead 1464 to alternatively contact the recess 1473 and the protrusion 1474, thereby causing the pickup roller 134 to vibrate.

Figure 8:
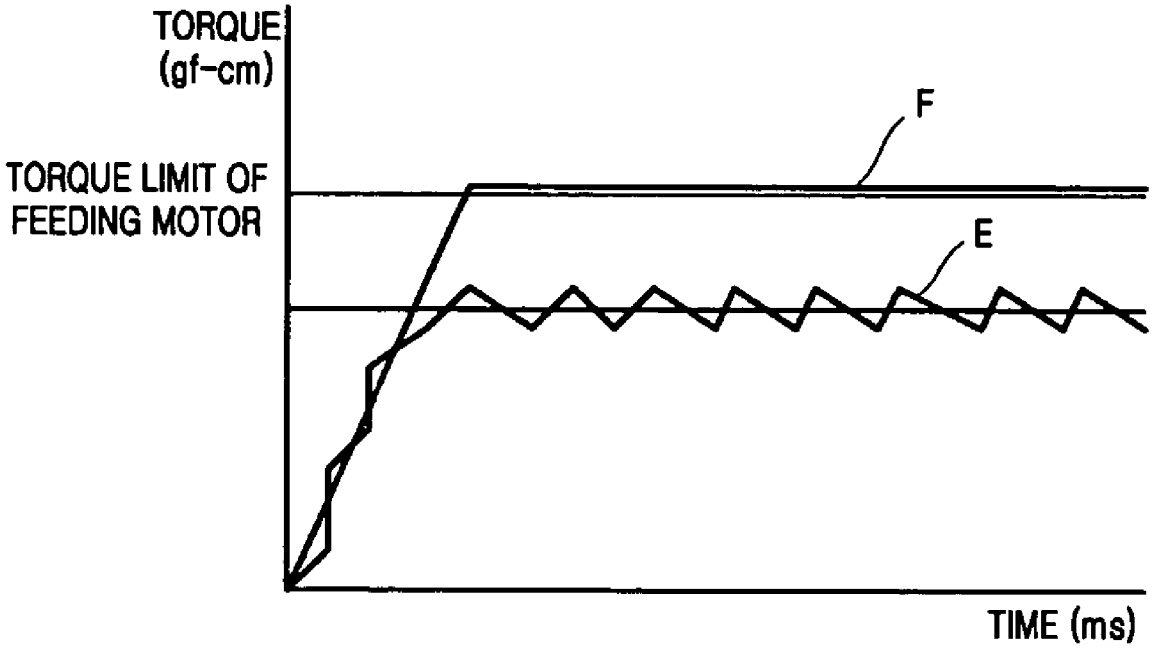
FIG. 8 is a graph showing a plot of torque versus time to compare a pickup roller according to the present general inventive concept and a conventional pickup roller.

Referring to FIG. 8, in a case of the pickup device 130 according to an aspect of the present general inventive concept, "E" of the pickup roller 136 shows that the pickup roller 136 vibrates while picking up the sheets of paper S and even when the pickup roller 136 is overloaded and cannot pick up the sheets of paper S. As the pickup roller 136 vibrates, the pickup roller 136 repeatedly contacts each sheet of paper S so that contact point is changed. Thus, the pickup roller 136 can easily pick up the sheets of paper S.

On the other hand, in a case of a pickup roller of a conventional pickup device, "F" of the pickup roller of the conventional pickup roller shows that the pickup roller is driven until it reaches a torque limit. Then, the torque is transmitted to a driving motor, thereby blocking the driving motor.

As described above, a pickup device used with an image forming apparatus according to the embodiment of the present general inventive concept provides a pickup roller that can slide and does not pass the overload of the pickup roller to a power source, thereby increasing the reliance of the pickup device. In addition, according to the present general inventive concept, sheets of paper can be easily picked up using the vibration of the pickup roller.

While the present invention has been particularly shown and described with reference to exemplary embodiments thereof, it will be understood by those of ordinary skill in the art that various changes in form and details may be made therein without departing from the spirit and scope of the present invention as defined by the following claims and their equivalents.

What is claimed is:

1. A pickup device comprising:

a driving roller;

a pickup roller that receives a driving force from the driving roller through a rotating axle disposed within the pickup roller, and picks up sheets of paper one by one; and a lockup prevention device that is disposed between the pickup roller and the rotating axle and unwinds to allow the rotating axle to slide with respect to the pickup roller according to an overload of the pickup roller so that the overload of the pickup roller is not transmitted to the driving roller.

2. The pickup device of claim 1, wherein the lockup prevention device comprises:

a middle element that is fixedly coupled to the rotating axle; and an elastic unit that has one end fixedly coupled to the pickup roller and slides with respect to the middle element so that when the pickup roller is overloaded, the elastic unit relatively slides over the middle element and does not transmit the overload to the middle element.

3. The pickup device of claim 2, wherein the elastic unit comprises:

a winding portion that is wound around the middle element; and a transition portion that has a larger diameter than the winding portion so that the transition portion does not contact the middle element.

4. The pickup device of claim 3, wherein the pickup roller comprises a fixing unit, and a lead of the transition portion is secured to the fixing unit of the pickup roller so that the transition portion is unwound around the middle element in an opposite direction to a rotating direction of the rotating axle.

5. The pickup device of claim 3, further comprising:

a cap that is inserted to one side of the pickup roller and has a plurality of protrusions disposed at a predetermined distance from each other on one end thereof, wherein the elastic unit repeatedly slides back and forth along a lengthwise direction of the middle element to generate a vibration to the pickup roller as a lead of the winding portion contacts at least one of the protrusions.

6. An image forming apparatus comprising a paper cassette where sheets of paper are loaded, and a transfer device that transfers the sheets of paper to a main body to form an image on the sheets of paper, comprising:

a pickup device that picks up the sheets of paper from the paper cassette one by one to feed the picked-up sheet of paper to the transfer device, and the pickup device comprises, a driving roller, a pickup roller that receives a driving force from the driving roller through a rotating axle disposed within the pickup roller and picks up the sheets of paper one by one, and a lockup prevention device that is disposed between the pickup roller and the rotating axle and unwinds to allow the rotating axle to slide with respect to the pickup roller according to an overload of the pickup roller so that the overload of the pickup roller is not transmitted to the driving roller.

7. The image forming apparatus of claim 6, wherein the lockup prevention device comprises:

a middle element that is fixedly coupled the rotating axle; and an elastic unit that has one end fixedly coupled to the pickup roller and slides with respect to the middle element so that when the pickup roller is overloaded, the elastic unit relatively slides over the middle element and does not transmit the overload to the middle element.

8. The image forming apparatus of claim 7, wherein the elastic unit comprises:

a winding portion that is wound around the middle element; and a transition portion that has a larger diameter than the winding portion so that the transition portion does not contact the middle element.

9. The image forming apparatus of claim 8, wherein the pickup roller comprises a fixing unit, and a lead of the transition portion is secured to the fixing unit of the pickup roller so that the transition portion becomes unwound around the middle element in an opposite direction to a rotating direction of the rotating axle.

10. The image forming apparatus of claim 8, further comprising:

a cap that is inserted to one side of the pickup roller and has a plurality of protrusions disposed at a predetermined distance from each other on one end thereof, wherein the elastic unit repeatedly slides back and forth along a lengthwise direction of the middle element to generate a vibration to the pickup roller as a lead of the winding portion contacts at least one of the protrusions.

11. A pickup device used with an image forming apparatus, comprising:

a driving roller;

a pickup roller to pickup sheets of paper;

a rotating axle to transmit a driving force from the driving roller to the pickup roller; and a lockup prevention device disposed between the pickup roller and the rotating axle to transfer the driving force from the rotating axle to the pickup roller and not to transfer from the pickup roller to the driving roller through the rotating axle by unwinding to allow the rotating axle to slide with respect to the pickup roller when a friction with the sheets of paper slows a rotation of the pickup roller.

12. The pickup device of claim 11, wherein the lockup prevention device comprises:

a middle element fixedly coupled to the rotating axle;

a cap fixedly coupled to a portion of the pickup roller; and an elastic unit disposed between the middle element and the pickup roller, and having a first end coupled to another portion of the pickup roller and a second end disposed to contact to the cap.

13. The pickup device of claim 12, wherein the middle element comprises a cylinder into which the rotation axle is inserted, and the middle element rotates together with the rotating axle.

14. The pickup device of claim 12, wherein the cap comprises at least one fixed protrusion, and the pickup roller comprises at least one recess corresponding to the at least one protrusion of the cap so that the cap rotates together with the pickup roller.

15. The pickup device of claim 12, wherein the elastic unit comprises a winding portion to be wound around a first portion of the middle element, and a transition portion extended from the winding portion to be wound around a second portion of the middle element.

16. The pickup device of claim 15, wherein the transition portion and the winding portion are wound around the middle element in the same direction.

17. The pickup device of claim 15, wherein the transition portion is spaced-apart from an outer circumference of the second portion of the middle element.

18. The pickup device of claim 15, wherein the transition portion comprises a distal end disposed opposite to the winding portion and coupled to the pickup roller so that the pickup roller rotates together with the elastic unit.

19. The pickup device of claim 15, wherein the cap comprises at least one protrusion and at least one recess, and the elastic unit comprises one end to contact the at least one protrusion and the at least one recess to generate a vibration to the pick up roller.

20. The pickup device of claim 19, wherein the pickup roller selectively contacts the sheets of paper according to the vibration transferred from the elastic unit to the pickup roller.

21. The pickup device of claim 19, wherein the pickup roller contacts a first and a second portions of the sheet of paper to be picked up according to the vibration.

22. The pickup device of claim 12, wherein the elastic unit slides with respect to the middle element according to a load exerted on the pickup roller.

23. The pickup device of claim 22, wherein the elastic unit generates a vibration according to a rotation of the middle element, and the pickup roller vibrates according the vibration of the elastic unit.

24. The pickup device of claim 11, wherein the lockup prevention device generates a vibration, and a contact force between the pickup roller and the sheet of paper is changed according to the vibration of the lockup prevention device, and the pickup roller picks up the sheet of paper using the changed contact force.

25. A pickup device usable with an image forming apparatus, comprising:

a pickup roller to pick up a sheet of paper;

a driving roller to provide a driving force to the pickup roller;

an axle disposed inside of the pickup roller; and a lockup prevention device disposed between the pickup roller and the axle, having a first portion coupled to the axle and a second portion coupled to the axle, and to be elastically deformable according to a rotation of one of the pickup roller and the axle to prevent the transmission of an overload force from the pickup roller to the axle.

26. The pickup device according to claim 25, wherein the lockup prevention device comprises;

a middle element fixedly coupled to the axle;

an elastic unit wound around the middle element and coupled to the pickup roller to transmit the driving force of the axle to the pickup roller through the middle element, wherein the elastic unit is wound such that when the pickup roller is overloaded, the elastic unit expands and the middle element slides against the elastic unit.

27. The pickup device according to claim 25, wherein the pickup roller comprises a hollow roller, and the axle is disposed in the hollow roller.

28. The pickup device according to claim 25, wherein the pickup roller, the axle, and the lockup prevention device are all disposed in a lengthwise direction.

29. The pickup device according to claim 25, wherein the lockup prevention device is disposed inside the pickup roller.

* * * * *